US010126102B2

(12) United States Patent
Teng et al.

(10) Patent No.: US 10,126,102 B2
(45) Date of Patent: Nov. 13, 2018

(54) AUTOMATIC SCORING DART TARGET DEVICE AND METHOD FOR AUTOMATICALLY OBTAINING DART SCORES OF THE SAME

(71) Applicant: NVTEK ELECTRONIC CO., LTD., Hsinchu (TW)

(72) Inventors: Wen-Chih Teng, Zhubei (TW); Chin-Wei Liu, Xinpu Township (TW)

(73) Assignee: NVTEK Electronic Co., Ltd., Hsinchu (TW)

( * ) Notice: Subject to any disclaimer, the term of this patent is extended or adjusted under 35 U.S.C. 154(b) by 0 days.

(21) Appl. No.: 15/399,123

(22) Filed: Jan. 5, 2017

(65) Prior Publication Data

US 2017/0191805 A1 Jul. 6, 2017

(30) Foreign Application Priority Data

Jan. 5, 2016 (TW) ..... 105100130 A

(51) Int. Cl.
*F41J 3/02* (2006.01)
*F41J 3/00* (2006.01)
*F41J 5/02* (2006.01)

(52) U.S. Cl.
CPC ..... *F41J 3/02* (2013.01); *F41J 3/0009* (2013.01); *F41J 5/02* (2013.01)

(58) Field of Classification Search
None
See application file for complete search history.

(56) References Cited

U.S. PATENT DOCUMENTS

2011/0031696 A1* 2/2011 Su ..... F41J 3/00 273/371
2016/0370155 A1* 12/2016 Dale ..... F41J 3/02

FOREIGN PATENT DOCUMENTS

CN 1244250 A 2/2000

OTHER PUBLICATIONS

Office Action of corresponding CN application, published on Jan. 2, 2018.

* cited by examiner

*Primary Examiner* — Omkar Deodhar
(74) *Attorney, Agent, or Firm* — Wang Law Firm, Inc.

(57) ABSTRACT

An automatic scoring dart target device and a method of using the same are provided. The device includes a dart target, a plurality of image capturing units, a background-shield and a processor. The dart target is made of solid material on which darts are shot. The image capturing units and the dart target are disposed on the same surface. The image capturing units respectively capture a plurality of images at intersecting directions. The background shield is disposed relative to the image capturing units so that the image capturing units can generate the background information. The processor calculates the scores based on the background information and locations of the dart in a selection of two images among the plurality of images individually captured by the corresponding plurality of image capturing units. Thus, the scores of landed darts can be automatically calculated when using the conventional dart target.

7 Claims, 7 Drawing Sheets

AUTOMATIC SCORING DART TARGET DEVICE AND METHOD FOR AUTOMATICALLY OBTAINING DART SCORES OF THE SAME

CROSS-REFERENCE TO RELATED APPLICATION

This application claims priority from Taiwan Patent Application No. 105100130, filed on Jan. 5, 2016, in the Taiwan Intellectual Property Office, the content of which is hereby incorporated by reference in its entirety for all purposes.

BACKGROUND OF THE INVENTION

1. Field of the Invention

The present invention relates to the technical field of automatically obtaining dart scores, especially an automatic scoring dart target device and a method for automatically obtaining dart scores of the same, where the device can automatically score and the method can be implemented with the conventional dart target or dartboard made of solid material.

2. Description of the Related Art

The game of darts is played for leisure and is also played competitively as a sport. The equipment used in the game is a dartboard and the darts. The prior art dartboard is commonly either a simple dart target made of solid material or an electronic dart target. When using a conventional dartboard made of solid material, the players generally have to calculate and keep track of the scores themselves. This might be considered as challenging for some players, and so automating the scoring process makes the game less of a hassle. For this reason, conventional solid-material dartboards have been gradually replaced by electronic dartboards.

The electronic dartboard of prior art generally has the dart sensing elements installed on the dartboard. The players throw darts at the dartboard, generally one at a time and taking turns between the players; and the scores are automatically recorded according to the signals generated by the sensing elements in the dartboard where the darts have landed on. However, in order to avoid damaging the electronic elements in the dartboard, the darts are mainly made of plastic and end up being lighter in weight than conventional darts. The relative light weight of a plastic dart can cause the player to feel the dart less in their hands and have greater difficulty in controlling the accuracy of a throw. The plastic dart will also more easily bend or become deformed at the front end after prolonged use, making it even harder for the player to control the accuracy of a throw. In another method, the electronic dartboard is fitted with electromagnetic coils and so the material chosen for the dart is therefore magnetic. However, a significant drawback of this method is that the process of embedding coils in the dartboard is complicated and so its cost is relatively high. Yet another method is to install a laser element in the electronic dartboard. However, its cost is also relatively high and there is also the potential risk of the laser causing damage to the player's eyes, should the eyes be exposed to the laser beams. So, in summary, electronic dartboards of prior art still have certain issues and are far from being widely affordable.

After several years of research of the prior art and related fields and following a comprehensive overview of the issues and limitations of electronic dartboards of the prior art, the inventor of the present disclosure has designed an automatic scoring dart target device together with a method using the same, which aims to improve on the shortcomings of the current technology and to make practical the industrial production thereof.

SUMMARY OF THE INVENTION

The objective of the present invention is to provide an automatic scoring dart target device and a method using the same, with the aim of addressing the aforementioned limitations of the prior art.

Given the objective of the present invention, an automatic scoring dart target device is provided, which includes a dart target, a first image capturing unit, a second image capturing unit, a third image capturing unit, a background shield, a lighting module, a processor and a case body. The dart target is made of solid material. The first image capturing unit and the dart target are installed on the same plane and the first image capturing unit faces toward the dart target to capture the first image, wherein an optical axis of the first image capturing unit is parallel to the horizontal direction of a surface plane of the dart target. The second image capturing unit and the dart target are installed on the same plane and the second image capturing unit faces toward the dart target to capture the second image, wherein an optical axis of the second image capturing unit is parallel to the horizontal direction of the surface plane of the dart target, and the direction of capturing the second image intersects with the direction of capturing the first image. The third image capturing unit and the dart target are installed on the same plane and the third image capturing unit faces toward the dart target to capture the third image, wherein an optical axis of the third image capturing unit is parallel to the horizontal direction of the surface plane of the dart target, and the direction of capturing the third image intersects with the directions of capturing the first image and the second image. The directions of capturing the first, second, and third images may be parallel to the surface plane of the dart target. The background shield partially surrounds the surrounding area of the dart target and it is disposed at a position relative to the first image capturing unit, the second image capturing unit, and the third image capturing unit, such that it blocks the view of objects other than the dart target and so allows the first image capturing unit, the second image capturing unit, and the third image capturing unit to generate the necessary background information. The lighting module is installed in the surrounding area of or in the area behind the background shield. Following the landing of a dart somewhere on the dart target, the processor obtains a first coordinate, a second coordinate, and a third coordinate based on the locations of the dart in the first image, the second image, and the third image respectively. When there are a plurality of darts on the dart target, and the processor determines that the first coordinate or the second coordinate of one of the darts overlaps with the first coordinate or the second coordinate of the previous dart, the processor calculates the score value based on the third coordinates together with either the first coordinates or the second coordinates, whichever are not overlapping. Additionally, the case body contains the dart target, the first image capturing unit, the second image capturing unit, the third image capturing unit, the background shield, the lighting module, and the processor; all installed therein. The case body has an opening and the dart target corresponds to the opening and is visually exposed to the outside of the case body.

Preferably, the present invention can further include a fitting rack which is mounted fixedly together with the dart target or allows the dart target to be mounted fixedly thereon. The first image capturing unit, the second image capturing unit, and the third image capturing unit are installed on the fitting rack. The first image capturing unit and the second image capturing image are located separately on both sides of the dart target, so that the direction of capturing the second image intersects with the direction of capturing the first image. The third image capturing unit is located between the first image capturing unit and the second image capturing image, so that the direction of capturing the third image intersects with the directions of capturing the first image and the second image.

Based on the objective of the present invention, a method for automatically obtaining dart scores is further provided, which includes the following steps: provide a dart target for at least one dart to be thrown thereon, and the dart target is made of solid material; install one first image capturing unit that is on the same plane as the dart target and faces toward the dart target, wherein an optical axis of the first image capturing unit is parallel to the horizontal direction of a surface plane of the dart target, so that the first image capturing unit can easily capture a first image; install one second image capturing unit that is on the same plane as the dart target and faces toward the dart target, wherein an optical axis of the second image capturing unit is parallel to the horizontal direction of the surface plane of the dart target, so that the second image capturing unit can easily capture a second image, and the direction of capturing the second image intersects with the direction of capturing the first image; install one third image capturing unit that is on the same plane as the dart target and faces toward the dart target, wherein an optical axis of the third image capturing unit is parallel to the horizontal direction of the surface plane of the dart target, so that the third image capturing unit can easily capture a third image, and the direction of capturing the third image intersects with the directions of capturing the first image and the second image, the directions of capturing the first, second, and third images may be parallel to the surface plane of the dart target; install a background shield, and the background shield partially surrounds the surrounding area of the dart target and it is disposed at a position relative to the first image capturing unit, the second image capturing unit, and the third image capturing unit, such that it blocks the view of objects other than the dart target and so allows the first image capturing unit, the second image capturing unit, and the third image capturing unit to generate the necessary background information, and furthermore, a lighting module is installed in the surrounding area of or the area behind the background shield; calculate the score value via the processor, by locating the landing spot of the dart based on the background information and locations of the dart in a selection of two images among the first image, the second image, and the third image.

Preferably, the present invention can further include the following steps: install the dart target, the first image capturing unit, the second image capturing unit, the third image capturing unit, the lighting module and the background shield inside a case body, and the dart target corresponds to an opening of the case body through which the data target is visually exposed to the outside of the case body.

Preferably, the present invention can further include the following steps: obtain a first coordinate, a second coordinate, and a third coordinate via the processor based on the locations of the dart in the first image, the second image, and the third image respectively; when there are a plurality of darts on the dart target, the processor determines whether the first coordinate or the second coordinate of one of the darts overlaps with the first coordinate or the second coordinate of the previous dart; and when the first coordinate or the second coordinate of the dart overlaps with the first coordinate or the second coordinate of the previous dart, the processor calculates the score value based on the third coordinate together with either the first coordinate or the second coordinate, whichever are not overlapping.

Preferably, the present invention can further include the following steps: provide a fitting rack which is mounted fixedly together with the dart target or allows the dart target to be mounted fixedly thereon; install the first image capturing unit, the second image capturing unit, and the third image capturing unit on the fitting rack, and the first image capturing unit and the second image capturing image are located separately on both sides of the dart target, and the third image capturing unit is located between the first image capturing unit and the second image capturing image, so that the direction of capturing the second image intersects with the direction of capturing the first image, and the direction of capturing the third image intersects with the directions of capturing the first image and the second image.

The technical characteristics of the present invention are explained further through the below detailed description of preferred embodiments together with accompanying drawings for illustration. They are herein presented in such a way so that the objectives, technical characteristics, and advantages of the present invention will become more fully understood by those skilled in the art to which the present invention belongs.

BRIEF DESCRIPTION OF THE DRAWINGS

The detailed description of the present invention given below is for illustration purposes only, and thus does not limit the scope of the present invention, of which

DESCRIPTION OF THE PREFERRED EMBODIMENTS

The present invention has been described with some preferred embodiments thereof and it is understood that many changes and modifications in the described embodiments can be carried out without departing from the scope and the spirit of the invention that is intended to be limited only by the appended claims.

The embodiments of the automatic scoring dart target device of the present invention are explained with reference to the following relevant diagrams. For the sake of clarity, each of the elements in the embodiments described below keep the same label throughout the present disclosure.

Figure 1:
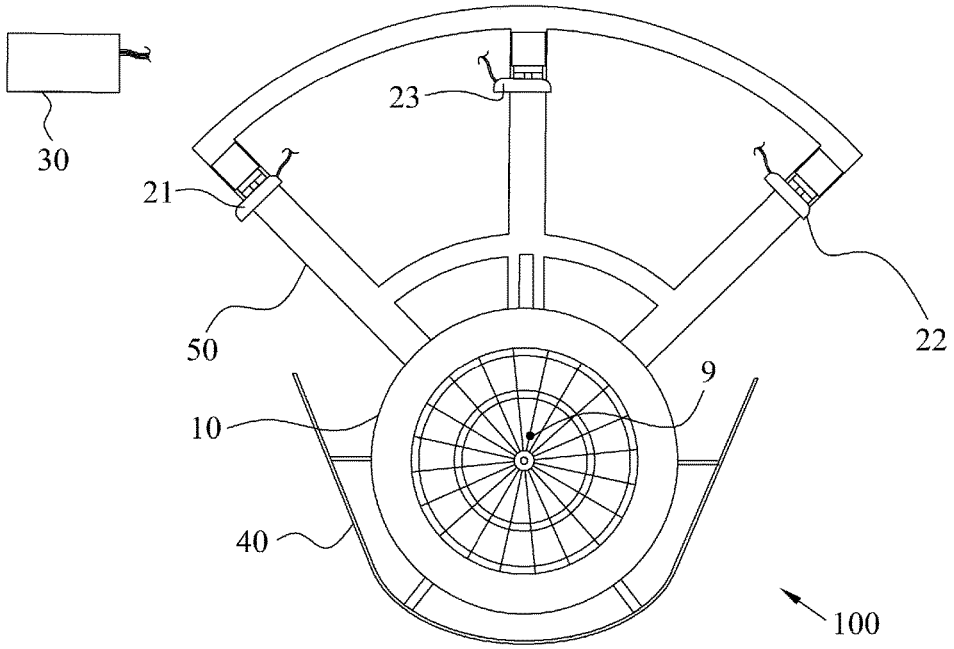
FIG. 1 is the first structural schematic diagram of the first embodiment of the automatic scoring dart target device of the present invention.
Figure 2:
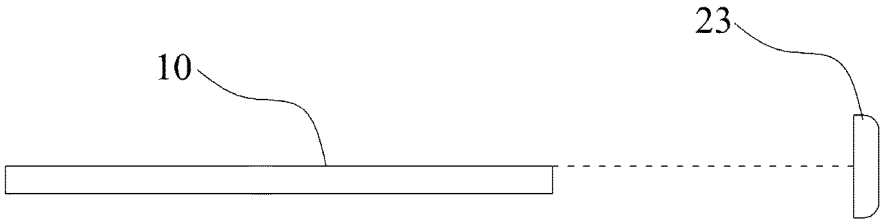
FIG. 2 is the second structural schematic diagram of the first embodiment of the automatic scoring dart target device of the present invention.
Figure 3:
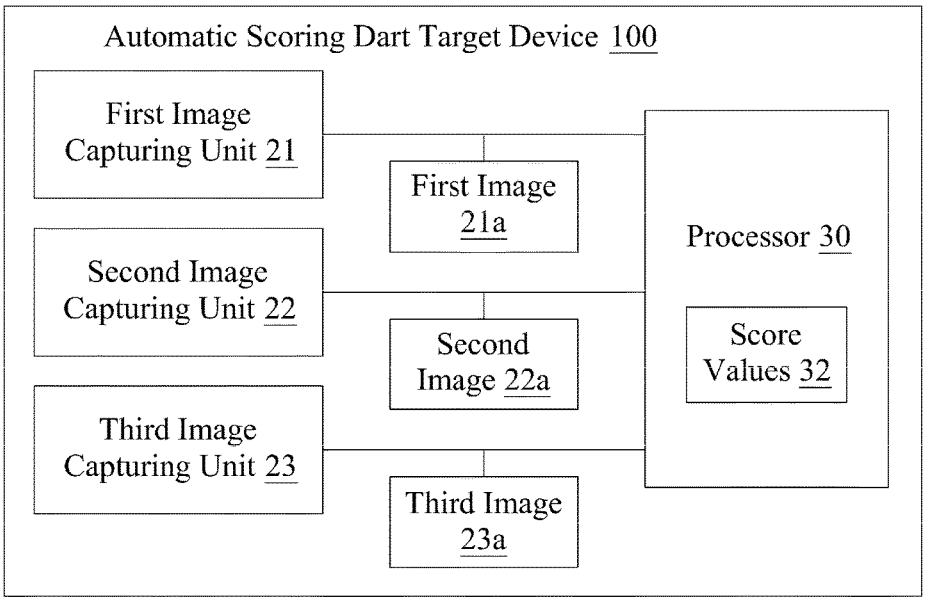
FIG. 3 is a block diagram of the first embodiment of the automatic scoring dart target device of the present invention.

Please refer to FIG. 1, FIG. 2 and FIG. 3, which are the first structural schematic diagram, the second structural schematic diagram and the block diagram of the first embodiment of the automatic scoring dart target device of the present invention respectively. As shown in the diagrams, the automatic scoring dart target device 100 of the present invention includes a dart target 10, a first image capturing unit 21, a second image capturing unit 22, a third image capturing unit 23, and a processor 30. The dart target 10 is made of solid material. A preferable dart target 10 can be a dart made of solid wood that can be installed on a flat surface and allow players to throw at least one dart 9 onto the dart target 10. The first image capturing unit 21, the second image capturing unit 22, the third image capturing unit 23, and the dart target 10 are installed on the same plane, and optical axes of the first image capturing unit 21, the second image capturing unit 22 and the third image capturing unit 23 are parallel to the horizontal direction of a surface plane of the dart target 10. The first image capturing unit 21, the second image capturing unit 22, and the third image capturing unit 23 face toward the dart target 10 individually in order to capture the first image 21*a*, the second image 22*a* and the third image 23*a* respectively.

It is worth noting that the direction of capturing the first image intersects with the direction of capturing the second image, whereas the direction of capturing the third image intersects with the directions of capturing the first image and the second image. In one embodiment, the directions of capturing the first, second, and third images may be parallel to the surface plane of the dart target. The processor 30 can be connected with the first image capturing unit 21, the second image capturing unit 22, and the third image capturing unit 23 using the wired or wireless connection method. The processor 30 obtains the landing spot of the dart 9 from locations of the dart 9 in a selection of two images among the first image 21*a*, the second image 22*a*, and the third image 23*a*, to calculate the score value 32 at the landing spot of the dart 9 that shall be given.

In other words, the automatic scoring dart target device 100 of the present invention applies the method of capturing, identifying, and interpreting images to calculate the score value 32 at the landing spot of the dart 9 that shall be given. Furthermore, the dart target 10 used by the automatic scoring dart target device 100 of the present invention can be a conventional dart target made of solid wood that allows players to throw conventional darts 9 made of metal, so that the inconvenience posed to the player to manually calculate the dart scores and the unrealistic hand feel on throwing while using plastic darts can be improved.

Furthermore, the automatic scoring dart target device 100 of the present invention may also include a background shield 40. The background shield 40 can surround the surrounding area of the dart target 10 partially in an arc shape and the location of the background shield 40 is relative to the first image capturing unit 21, the second image capturing unit 22, and the third image capturing unit 23. The function of the background shield 40 is to block the scenery or objects outside the dart target 10 and to allow the first image capturing unit 21, the second image capturing unit 22, and the third image capturing unit 23 to generate the background information. The background information refers to images, captured by the first image capturing unit 21, the second image capturing unit 22, and the third image capturing unit 23, with no dart 9 on the dart target. The preferable background shield 40 can be a single color, such as blue, green, white, or translucent background shield 40, preferably with a greenish color, so that a first image 21*a*, a second image 22*a* and a third image 23*a* with much simpler backgrounds can be obtained by the first image capturing unit 21, the second image capturing unit 22, and the third image capturing unit 23. In addition, by using the background information of images that have no dart 9 on the dart target along with the first image 21*a*, the second image 22*a* and the third image 23*a*, the processor 30 can quickly, conveniently and accurately derive or identify the dart 9 from the first image 21*a*, the second image 22*a* and the third image 23*a*, and subsequently calculate the score value 32 at the landing spot of the dart 9.

Furthermore, the automatic scoring dart target device 100 of the present invention may also include a fitting rack 50. The fitting rack 50 allows the dart target to be mounted fixedly thereon or is mounted fixedly together with the dart target 10 on the flat surface, and allows the first image capturing unit 21, the second image capturing unit 22, and the third image capturing unit 23 to be mounted fixedly thereon. In a preferred embodiment, the fitting rack 50 can be a fan-shaped structure; the center of the fan-shaped fitting rack 50 is located at the center of the dart target 10. Both sides of the fitting rack 50 and any spot located between both sides thereof may be installed with a plurality of assembly parts (not shown in the drawings) that correspond to the number of image capturing units, so that the first image capturing unit 21 and the second image capturing unit 22 can be installed separately on both sides of the fitting rack 50. The third image capturing unit 23 is installed between the first image capturing unit 21 and the second image capturing unit 22. Preferably, the distances from the first image capturing unit 21, the second image capturing unit 22, the third image capturing unit 23 to the center of the dart target 10 respectively are equal in order to better conduct the calculation or to plan the components layout. The aforementioned assembly parts may be implemented in the forms such as a plurality of lock holes, adhesives, insert holes, etc.; for instance, the image capturing unit can be mounted fixedly on the assembly part of the fitting rack 50 by locks. The implementation of assembly parts is well-known to those skilled in the art, so unnecessary details will be omitted here. Using the configuration of the fitting rack 50, during the setup of the first image capturing unit 21, the second image capturing unit 22, and the third image capturing unit 23, the procedure of position calibration on the first image capturing unit 21, the second image capturing part 22, and the third image capturing unit 23 can be saved.

Furthermore, the capturing direction of the first image capturing unit 21 may be perpendicular to the capturing direction of the second image capturing unit 22, so as to increase the efficiency in calculating the score value 32 to be awarded to the landing spot of the dart 9.

Please refer to FIG. 3, i.e. the schematic diagram of obtaining the coordinates in the first embodiment of the automatic scoring dart target device of the present invention. As shown in the figure, the processor 30 obtains the landing spot of the dart 9 from locations of the dart 9 in a selection of two images out of the first image 21*a*, the second image 22*a*, and the third image 23*a*, to calculate the score value 32 to be awarded to the landing spot of the dart 9. In this preferred embodiment, the processor 30 can obtain a first coordinate based on the location of the dart 9 in the first image 21*a*, such as the X value in the coordinate, and a second coordinate based on the location of the dart 9 in the second image, such as the Y value in the coordinate, in order to calculate the landing spot of the dart 9 from the first coordinate and the second coordinate, as well as to calculate the score value 32 based on the landing spot of the dart 9.

Furthermore, another embodiment is provided. The angle of view of the image capturing unit can be configured to just cover the dart target 10, such that the image contains only the dart target 10 and the darts 9. In the setting, scale values of 0 to 100 are set to correspond to locations from one edge across to the other edge of the dart target 10 or scale values of 0 to ±50 are set to correspond to locations from the center outward to both edges of the dart target 10, so that the processor 30 can obtain the X value or Y value of the dart 9 according to the position thereof in the image to calculate the landing spot of the dart 9 based on the X value and Y value, and to obtain the score value 32.

Figure 4:
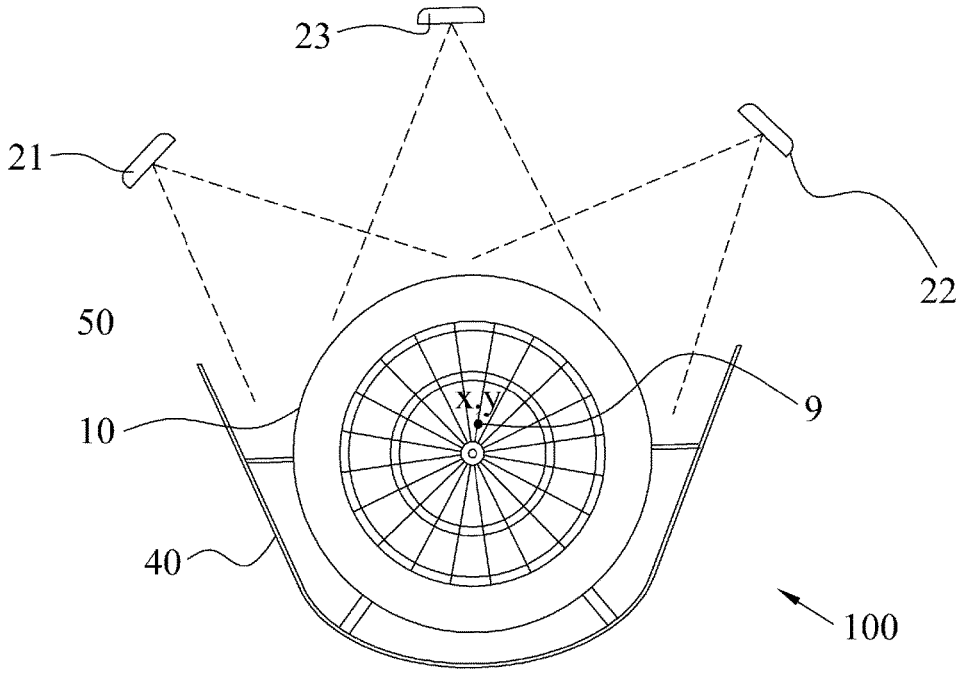
FIG. 4 is a schematic diagram showing the acquisition of the coordinates of landed darts, in the first embodiment of the automatic scoring dart target device of the present invention.

Please refer to FIG. 4, the schematic diagram of selectively utilizing the first coordinate or the second coordinate, and the third coordinate in the first embodiment of the automatic scoring dart target device of the present invention. As shown in the diagram, dart games or dart competitions generally use the total score, by summing up scores earned by each of a plurality of darts 9, as the rating. Under a special circumstance, it may happen that two darts 9 are thrown and only one dart 9 can be seen in the capturing direction (or angle of view) of the first image capturing unit 21 or the second image capturing unit 22. In other words, the darts visually overlap in the capturing direction of the first image capturing unit 21 or the second image capturing unit 22. In order to prevent misjudgment of the scores from happening due to this condition, a third image capturing unit 23 can be added as a supplementary solution.

To explain in detail, when the dart target 10 has a plurality of darts 9 thereon, and when the processor 30 determines that the first coordinate or the second coordinate of one of the darts 9 overlaps with the first coordinate or the second coordinate of the previous dart 9, the processor 30 can calculate the score value 32 based on the third coordinates together with either the first coordinates or the second coordinates, whichever are not overlapping. Although the aforementioned embodiment refers to an overlapping of coordinates, however, in the practical application, the embodiment may be implemented by setting a range. For example, when the difference of value of the first coordinate of one of the darts 9 and the first coordinate of the previous dart 9 is within a preset range, the third coordinate X' and the second coordinate Y are used to calculate the landing spot of the one dart 9 in order to obtain the score value 32 thereof.

It is worth noting that although the aforementioned embodiment applies the coordinate obtained from the third image as the supplementary solution, the purpose is to mainly explain the concept of using the image obtained by the third image capturing unit to help to determine the landing spot of the dart 9. Therefore, the first image 21*a* and the third image 23*a* can also be used mainly whereas the second image is supplementary, or the second image and the third image can be used mainly whereas the first image 21*a* is supplementary. The present invention can be implemented in different forms and the forms of illustration stated above are not intended to limit the scope of the present invention in any way.

In addition, the automatic scoring dart target device 100 of the present invention is not limited to three image capturing units. In actual applications, a fourth image capturing unit also can be used, or even a fifth image capturing unit can be included. Therefore, the present invention can be implemented in different forms and the forms of illustration stated above are not intended to limit the scope of the present invention in any way.

Figure 5:
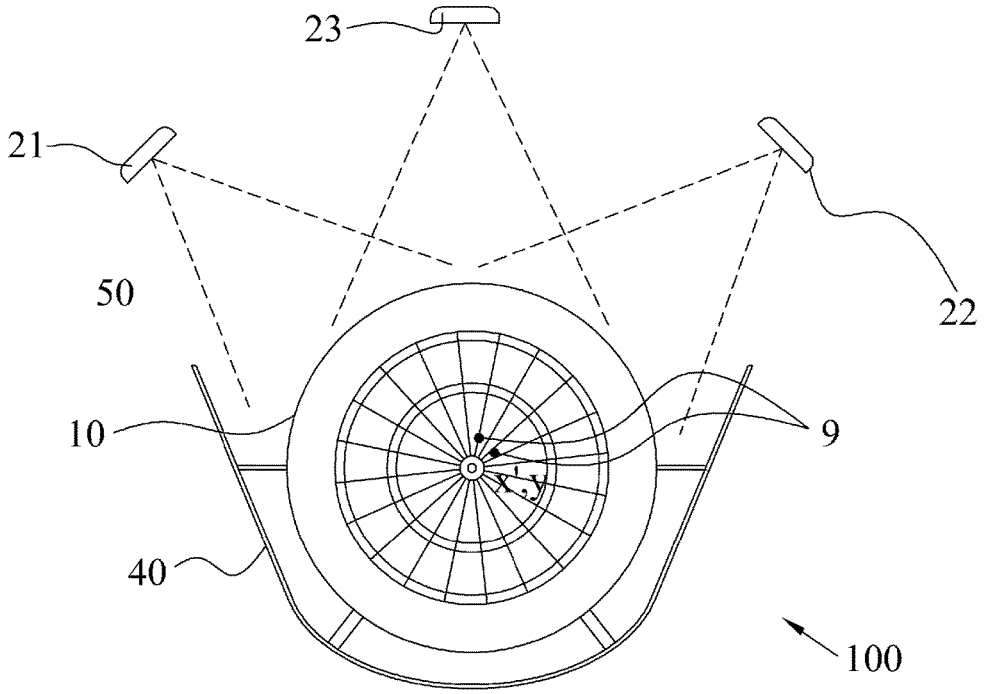
FIG. 5 is a schematic diagram showing the use of either the first coordinate or the second coordinate, together with the third coordinate, in the first embodiment of the automatic scoring dart target device of the present invention.

Please refer to FIG. 5, the structural schematic diagram of the second embodiment of the automatic scoring dart target device of the present invention. As shown in the diagram, in a preferred embodiment, the automatic scoring dart target device 100 can further include a case body 60. The case body 60 has a containing space, and the dart target 10, the first image capturing unit 21, the second image capturing unit 22, the third image capturing unit 23, the processor 30, the background shield 40 and the fitting rack 50 can be installed therein. In addition, the case body 60 can have an opening 61, and the dart target 10 corresponds to the location of the opening 61 and the dart target 10 is visually exposed to the outside of the case body 60, so that players can throw and land darts at the dart target 10. The case body 60 can cover elements of the first image capturing unit 21, the second image capturing unit 22, the third image capturing unit 23, the processor 30, the background shield 40, and the fitting rack 50.

In addition, the processor 30 can be integrated to a computer equipment and connected with the first image capturing unit 21, the second image capturing unit 22, and the third image capturing unit 23 through the wired or wireless connection method in order to obtain the first to the third images and to conduct the calculation of score values 32.

It is worth noting that since the first image capturing unit 21, the second image capturing unit 22, and the third image capturing unit 23 are installed in the case body 60, the backgrounds of images obtained by the first image capturing unit 21, the second image capturing unit 22, and the third image capturing unit 23 already have been simplified. For the first image capturing unit 21, the second image capturing unit 22, and the third image capturing unit 23 to capture images more easily, one or multiple LED lighting modules can be installed around the background shield 40, such as locations on both sides and in the area above or below thereof, in order to provide supplemental lighting and to eliminate problems due to insufficient light during image capture. In addition, when the background shield 40 is translucent, the lighting module can be installed behind the background shield 40 as lighting.

Furthermore, the automatic scoring dart target device 100 can also include a display module 70 that is visible on the case body 60 to display the score value 32 of each dart 9, the accumulated score value 32 of a plurality of darts 9, or a combination thereof. Hereby, the score obtained by each player simply can be known.

In addition, the automatic scoring dart target device 100 can also include a transmission module (not shown in the diagram). The transmission module can be a WIFI module or a connection port for a physical connection cable in order to transmit the score values 32 or the accumulated score values 32. In other words, by means of the network connection, the automatic scoring dart target device 100 can calculate and compare the score values 32 or the accumulated score values 32 of darts 9 in different regions. Therefore, players are not restricted to be in the same area. Even if players are far away from one another, players can still carry out dart games or dart competitions through the network connection.

Figure 6:
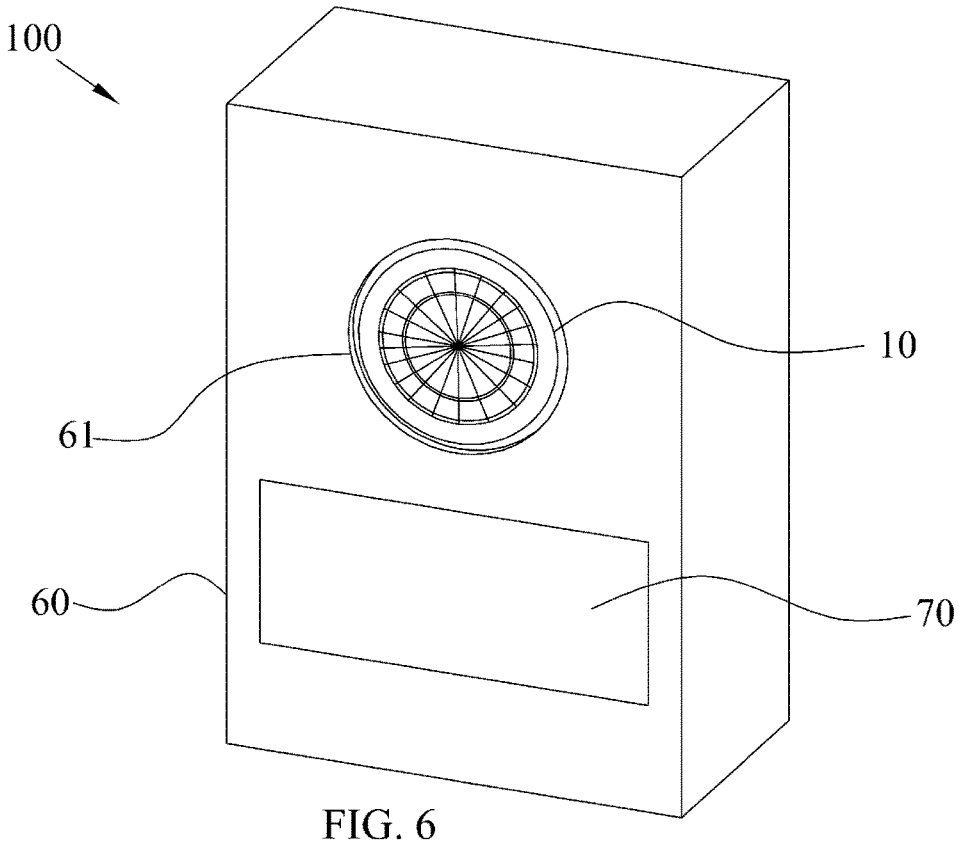
FIG. 6 is a structural schematic diagram of the second embodiment of the automatic scoring dart target device of the present invention.
Figure 7:
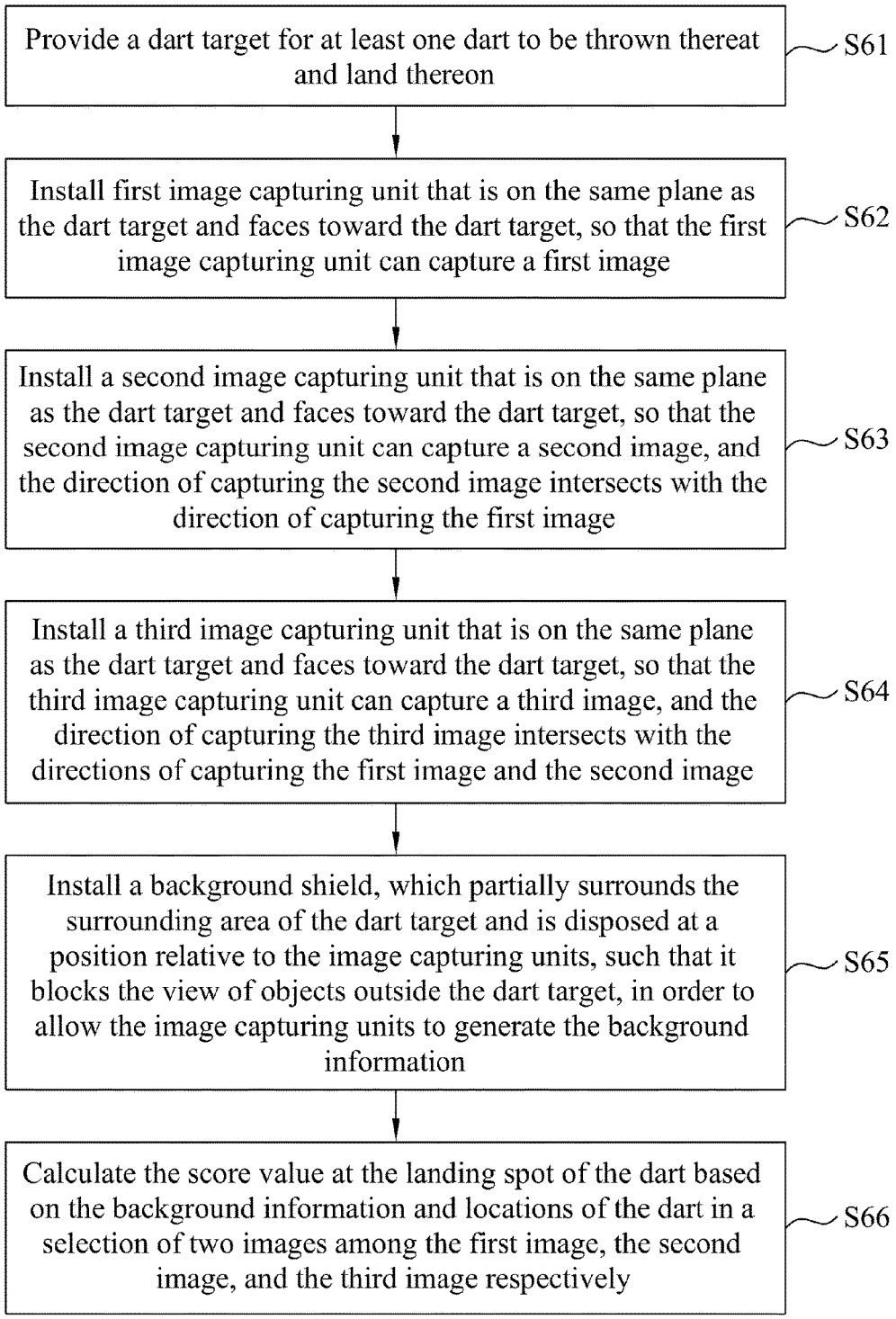
FIG. 7 is a flowchart illustrating the method for automatically obtaining dart scores of the present invention.

Please refer to FIG. 6, which is the flowchart illustrating the method for automatically obtaining dart scores of the present invention. As shown in the diagram, the method using an automatic scoring dart target device includes the following steps: (S61) provide a dart target for at least one dart to be thrown thereon; (S62) install the first image capturing unit that is on the same plane as the dart target and faces toward the dart target, and an optical axis of the first image capturing unit is parallel to the horizontal direction of a surface plane of the dart target, so that the first image capturing unit can capture a first image; (S63) install the second image capturing unit that is on the same plane as the dart target and faces toward the dart target, and an optical axis of the second image capturing unit is parallel to the horizontal direction of the surface plane of the dart target, so that the second image capturing unit can capture a second image, and the direction of capturing the second image intersects with the direction of capturing the first image; (S64) install the third image capturing unit that is on the same plane as the dart target and faces toward the dart target, and an optical axis of the third image capturing unit is parallel to the horizontal direction of the surface plane of the dart target, so that the third image capturing unit can capture a third image, and the direction of capturing the third image intersects with the directions of capturing the first image and the second image; the directions of capturing the first, second, and third images may be parallel to the surface plane of the dart target; (S65) install a background shield, which partially surrounds the surrounding area of the dart target and is disposed at a position relative to the image capturing units, such that it blocks the view of objects outside the dart target, so as to allow the image capturing units to generate the background information; and (S66) calculate the score value at the landing spot of the dart based on the background information and locations of the dart in a selection of two images among the first image, the second image, and the third image, via the processor 30.

The detailed description and embodiments of the method using the automatic scoring dart target device of the present invention has been provided already while describing the automatic scoring dart target device previously and will not be repeated here again.

In summary, by installing the image capturing units and the processor, under the condition that players carry out dart games or dart competitions using conventional darts and dart targets, the score values of darts that hit the dart target can still be calculated automatically. In addition, having the configuration of a background shield and a lighting module, locations of darts captured by the image capturing units can be clearer and simpler. Thus, the score value calculated by the processor is more accurate. The present invention also provides a fitting rack, so that the procedure of position calibration on the image capturing units can be simplified. The present invention can achieve the least setup cost and setup space. The present invention can be applied to not only conventional dart targets but also electronic dart targets. By using the image capturing units, the background shield, and the processor only, the present invention can carry out the clear and accurate method of score calculation.

In various embodiments, the processor 30 may be a uniprocessor system or a multiprocessor system having several processing cores. For instance, the processor 30 may include two, four, eight, or any appropriate number of cores. In an embodiment the processor 30 may be a general purpose processor or embedded processor that implement any of a variety of instruction set architectures (ISAs), e.g. the x86, PowerPC, SPARC, or MIPS ISAs, or any other suitable ISAs known to the person skilled in the art. In multiprocessor systems, each of the processing cores of the processor 30 may commonly implement the same ISA, but not limited thereto.

In accordance with the embodiment(s) of the present invention, the components, process steps, and/or data structures described herein may be implemented using various types of operating systems, computing platforms, computer programs, and/or general purpose machines. In addition, those of ordinary skill in the art will recognize that devices of a less general purpose nature, such as hardwired devices, field programmable gate arrays (FPGAs), application specific integrated circuits (ASICs), or the like, may also be used without departing from the scope and spirit of the inventive concepts disclosed herein. Where a method including a series of process steps is implemented by a computer or a machine and those process steps can be stored as a series of instructions readable by the machine, they may be stored on a tangible medium such as a computer memory device (e.g., ROM (Read Only Memory), PROM (Programmable Read Only Memory), EEPROM (Electrically Erasable Programmable Read Only Memory), FLASH Memory, Jump Drive, and the like), magnetic storage medium (e.g., tape, magnetic disk drive, and the like), optical storage medium (e.g., CD-ROM, DVD-ROM, paper card and paper tape, and the like) and other known types of program memory.

The methods described herein may be implemented in software, hardware, or a combination thereof. In addition, parts of the steps of the method may be changed and various elements may be added, recorded combined, omitted, modified, etc. While the means of specific embodiments in present disclosure has been described by reference drawings, numerous modifications and variations could be made thereto by those skilled in the art without departing from the scope and spirit of the invention set forth in the claims. The modifications and variations should in a range limited by the specification of the present disclosure.

The aforementioned descriptions are for illustration only and shall not be interpreted to limit the scope, applicability or configuration, of the present invention in any way. Any alternative embodiments that are modified or changed without departing from the spirit and scope of the present invention shall be included in the appended claims.

What is claimed is:

1. An automatic scoring dart target device that comprises:

a dart target being made of solid material and allowing at least one dart to be thrown thereon;

a first image capturing unit being installed on a same plane as the dart target and facing toward the dart target to capture a first image;

a second image capturing unit being installed on the same plane as the dart target and facing toward the dart target to capture a second image, wherein a direction of capturing the second image intersects with a direction of capturing the first image;

a third image capturing unit being installed on the same plane as the dart target and facing toward the dart target to capture a third image, wherein a direction of capturing the third image intersects with the directions of capturing the first image and the second images respectively, and the directions of capturing the first, second, and third images are parallel to a surface of the dart target;

a background shield partially surrounding a surrounding area of the dart target, wherein a location of the background shield is relative to the first image capturing unit, the second image capturing unit, and the third image capturing unit, in order to block views of objects outside the dart target and to allow the first image capturing unit, the second image capturing unit, and the third image capturing unit to generate background information; a lighting module is installed in a surrounding area of or an area behind the background shield;

a processor calculating a score value at a landing spot of the dart based on the background information and locations of the dart in a selection of two images among the first image, the second image, and the third image; and a case body containing the dart target, the first image capturing unit, the second image capturing unit, the third image capturing unit, the background shield, and the processor installed therein, wherein the case body has an opening;

the dart target corresponds to the opening and is visually exposed to outside of the case body.

2. The automatic scoring dart target device of claim 1, further comprising a fitting rack being mounted fixedly together with the dart target or allowing the dart target to be mounted fixedly thereon; wherein the first image capturing unit, the second image capturing unit, and the third image capturing unit are installed on the fitting rack; the first image capturing unit and the second image capturing image are located separately on both sides of the dart target, so that the direction of capturing the second image intersects with the direction of capturing the first image; the third image capturing unit is located between the first image capturing unit and the second image capturing image, so that the direction of capturing the third image intersects with the directions of capturing the first image and the second image.

3. A method for obtaining dart scores automatically, comprising steps of:

providing a dart target to allow at least one dart to be thrown thereon, the dart target being made of solid material;

installing a first image capturing unit, the first image capturing unit being installed on a same plane as the dart target and facing toward the dart target to capture a first image;

installing a second image capturing unit, the second image capturing unit being installed on the same plane as the dart target and facing toward the dart target to capture a second image, wherein a direction of capturing the second image intersects with a direction of capturing the first image;

installing a third image capturing unit, the third image capturing unit being installed on the same plane as the dart target and facing toward the dart target to capture a third image, wherein a direction of capturing the third image intersects with the directions of capturing the first image and the second images respectively, and the directions of capturing the first, second, and third images are parallel to a surface of the dart target;

installing a background shield, wherein the background shield partially surrounds a surrounding area of the dart target; a location of the background shield is relative to the first image capturing unit, the second image capturing unit, and the third image capturing unit, in order to block views of objects outside the dart target and to allow the first image capturing unit, the second image capturing unit, and the third image capturing unit to generate background information; a lighting module is installed in a surrounding area of or an area behind the background shield; and calculating a score value at a landing spot of the dart based on the background information and locations of the dart in a selection of two images among the first image, the second image, and the third image, via a processor.

4. The method for obtaining dart scores automatically of claim 3, further comprising steps as follows:

providing a fitting rack which is mounted fixedly together with the dart target; and installing the first image capturing unit, the second image capturing unit, and the third image capturing unit on the fitting rack, wherein the first image capturing unit and the second image capturing image are located separately on both sides of the dart target, and the third image capturing unit is located between the first image capturing unit and the second image capturing image, so that the direction of capturing the second image intersects with the direction of capturing the first image, and the direction of capturing the third image intersects with the directions of capturing the first image and the second image.

5. The automatic scoring dart target device of claim 1, wherein the processor obtains a first coordinate, a second coordinate and a third coordinate based on the locations of the dart in the first image, the second image, and the third image respectively; when there are a plurality of the darts on the dart target and the processor determines that the first coordinate or the second coordinate of one of the darts overlaps with the first coordinate or the second coordinate of a previous dart, the processor calculates the score value based on the third coordinate together with either the first coordinate or the second coordinate, whichever are not overlapping.

6. The method for obtaining dart scores automatically of claim 3 further comprising step as follows:

installing the dart target, the first image capturing unit, the second image capturing unit, the background shield, and the background shield in a case body;

wherein the dart target corresponds to an opening of the case body and is visually exposed to outside of the case body.

7. The method for obtaining dart scores automatically of claim 3, further comprising steps as follows:

obtaining a first coordinate, a second coordinate, and a third coordinate via the processor based on the locations of the dart in the first image, the second image, and the third image respectively;

when there are a plurality of the darts on the dart target, determining whether the first coordinate or the second coordinate of one of the darts overlaps with the first coordinate or the second coordinate of a previous dart via the processor; and when the first coordinate or the second coordinate of the dart overlaps with the first coordinate or the second coordinate of the previous dart, calculating the score value based on the third coordinates together with either the first coordinates or the second coordinates, whichever are not overlapping, via the processor.

* * * * *